US005417294A

United States Patent [19]

Suher

[11] Patent Number: 5,417,294

[45] Date of Patent: May 23, 1995

[54] PNEUMATIC HAMMER

[75] Inventor: Frank R. Suher, Chesterfield, Mo.

[73] Assignee: American Pneumatic Technologies, O'Fallon, Mo.

[21] Appl. No.: 212,965

[22] Filed: Mar. 15, 1994

[51] Int. Cl.[6] ..... B25D 17/10

[52] U.S. Cl. ..... 173/15; 173/168; 173/206; 173/211; 91/309; 91/317; 91/325

[58] Field of Search ..... 173/207, 206, 210, 211, 173/212, 15, 17, 168, 169; 91/304, 309, 317, 318, 325

[56] References Cited

U.S. PATENT DOCUMENTS

| | | | |
|---|---|---|---|
| 532,311 | 1/1895 | Carlinet . | |
| 907,041 | 12/1908 | Hampson . | |
| 1,117,884 | 11/1914 | Montgomery . | |
| 2,955,573 | 10/1960 | Feucht . | |
| 3,050,032 | 8/1962 | Carey | 173/15 |
| 3,086,501 | 4/1963 | Nielsen . | |
| 3,168,324 | 2/1965 | Kennell . | |
| 3,496,840 | 2/1970 | Wandel et al. . | |
| 3,968,843 | 7/1976 | Shotwell | 173/210 |
| 4,122,904 | 10/1978 | Haytayan . | |
| 4,133,393 | 1/1979 | Richards | 173/17 |
| 4,509,669 | 4/1985 | Elliesen . | |
| 4,776,408 | 10/1988 | Elkin et al. . | |
| 5,048,618 | 9/1991 | Lagne . | |
| 5,163,519 | 11/1992 | Mead et al. . | |
| 5,320,187 | 6/1994 | Pressley et al. | 173/168 |

*Primary Examiner*—Scott A. Smith

*Attorney, Agent, or Firm*—Kalish & Gilster

[57] ABSTRACT

A hammer of the type having an impact tool driven by pressurized fluid has a hammer body portion with a closed rearward end and an open forward end and a piston longitudinally movably housed within the hammer body portion for striking a tool mounted at the open forward end of the hammer body portion, to thereby impact an object with the tool. The hammer has a fluid valve housed within the closed rearward end of the hammer body portion rearwardly of the piston and in communication with a source of high pressure fluid for driving the piston. The fluid valve has a valve body portion defining an interior chamber and a continuous exterior side wall, and a longitudinal opening in communication with the interior chamber. The valve body has a first body portion and second body portion which is identical to the first body portion and positioned longitudinally in relation thereto within the closed rearward end of the hammer body portion. The first valve body portion and the second valve body portion each have at least one open-sided transverse channel extending from the continuous, external side wall of the wall to the internal valve chamber to thereby simplify and facilitate manufacture of the valve body, and the longitudinal opening and the open-sided transverse channels permit access of pressurized fluid through the valve chamber between the closed rearward end of the hammer body portion and the piston to direct the flow of pressurized fluid entering the valve.

20 Claims, 4 Drawing Sheets (Known Art)

PNEUMATIC HAMMER

BACKGROUND AND SUMMARY OF THE INVENTION

The present invention relates generally to the field of fluid driven power hand tools, and, more particularly, to a pneumatic hammer having a new air valve therein which permits economy of manufacture and prolonged useful life of the valve.

Pneumatic ("air") hammers are power hand tools which have been commonly used in the automotive assembly and repair fields, for example for muffler and shock absorber installation or replacement. Use of such tools is also well known in various industries where disassembly of nailed or bonded components is required, such as to break up wooden loading pallets or brake shoes, for example.

The type of pneumatic hammer which is especially relevant with regard to the present invention is usually a pistol-grip style hand tool that is equipped with a free-floating steel piston housed in the rear of a steel barrel. High pressure air is forced through the air valve of the hammer and causes the piston to travel outwardly from the rear end of the barrel to the open front end thereof, thus constituting one blow of the hammer. A chisel-like tool which has been inserted into the open end of the barrel is impacted by the piston and forced outwardly therefrom to impact an object with its face which is appropriately shaped for cutting, breaking, chipping, slitting, etc., in accordance with the work to be accomplished. Typically, such impact devices impact an object in the range of about 1,000 to about 3,000 blows per minute.

A problem with some known air hammers is in the placement of the air valve at the rear end of the barrel, opposite the tool. When the piston imparts strikes to an object via the tool, the air valve may also be subject to impact as the piston returns to pre-striking position. The result of such contact between the rear end of the piston and the valve is a broken valve and an inoperable tool. In normal use the air valve in the hammer is designed to direct the incoming air behind the piston and prevent valve/piston contact. However, due to misapplication and/or barrel loosening, the valve does not always function as intended, resulting in the aforementioned broken valve.

One known style of bi-directional valve 101 in pneumatic hammers, such as that shown in FIG. 15, generally designated 100, is an assembly of the following components: two identical valve body halves 102*a*, 102*b*, a thin paper gasket 103, a valve sleeve 104, and a valve disc 106. This known valve disc 106 is a stainless steel wafer, approximately 0.035 in. thick, which shuttles between the valve halves, alternately directing high pressure air to the back and front of the piston at a rate of approximately 2100 oscillations per minute. The valve sleeve 104 is used to align the valve body halves and provide a smooth bore for consistent disc operation. Without the valve sleeve the disc is able to catch on the edges at the intersection of the mating (facing) surfaces of the valve halves during operation of the hammer.

A further problem that occurs with the old style valve design is that the constant disc shuttling during tool operation causes valve fracture. The hardness of the stainless steel disc in the known pneumatic hammer is greater than that of the usual zinc alloy valve halves. Thus, during operation the metal disc of the known valve will peen and induce stress-fracture areas in the valve body, ultimately leading to complete valve and hammer failure. Of course a great deal of time and expense is involved in dismantling a hammer and replacing the valve therein.

Accordingly, attention has been given in the present invention to overcoming these shortfalls in air valves in known pneumatic hammers. In order to protect the new bi-directional air valve from piston impacts, a resilient bumper/seal combination has been installed in the valve end of the pneumatic hammer barrel. Being in the shape of a washer, and manufactured from a polyurethane or similar resilient, elastomeric material, the bumper/seal will serve three purposes: 1) prevention of piston to valve impact by absorption of the kinetic energy of the piston; 2) provision of a positive seal between the valve and barrel to ensure the formation of an air cushion when the piston is on the return stroke; and 3) acting as an energy storage medium that will absorb piston energy upon impact and release the energy back to the piston on the forward stroke, i.e., providing a spring effect. Incorporation of the new bumper/seal into the new valve of the present pneumatic hammer results in a significant increase in value and tool durability.

Also, to reduce the stresses incurred by the valve disc a new disc design has been provided. The new disc is fabricated from a phenolic or plastic material, rather than steel, and is formed to a thickness of approximately 0.067 in. Changing to a thicker disc has resulted in the elimination of the valve sleeve. The thicker disc is sized to protrude past the seam or intersection of the facing surfaces of the new valve body halves and eliminates the possibility of catching and hanging up on the seam. Testing has shown that the new valve disc reduces the peening forces and subsequent stress build-up which occurred in the known air valve. Accordingly, the new bi-directional valve has one less component (the known valve sleeve) and also has increased durability.

The design of the two facing halves of the new air valve has also been improved to optimize valve strength and to facilitate manufacturing. The mating portions of known pneumatic air valves were designed with two tunnel-like passageways 105 (FIG. 15) that ran transversely between the valve perimeter and a trough around the valve center port. Tooling to produce tunnels 105 was complex and expensive. Sharp corners and thin wall sections were inherent in the known design, and of course valve 101 was prone to fracturing around such thin wall sections and sharp corners during hammer 100 operation.

The valve of the new fluid driven hammer as described and shown herein is manufactured with valve halves which were heretofore unknown. The improved features of the new valve include at least two curved troughs having preferably "U"-shaped cross-sections on the mating faces of the valve halves, instead of the two passageways which tunnel through the side walls of the valve. The new valve also lacks sharp corners and thin wall sections that are subject to breakage. Furthermore, the costs of parts and tooling have been reduced with the new valve design. Accordingly, the valve strength and durability have been greatly increased without changing the size of the tool or its housing, so that it is adaptable to pre-existing air hammers, and the manufacturing costs overall have thus been decreased.

As may be seen from the above, it is an object of the present invention to provide an air valve for use in a pneumatic hammer, which valve is facile and inexpensive to manufacture and which has such increased durability relative to known air valves as to substantially prolong the useful life of the valve and thus decrease repair and maintenance costs of the associated pneumatic hammer.

It is further among the objects of the present invention, having the features indicated, that the new valve be suitably constructed for use in at least some presently known pneumatic hammers, so as to provide an improved replacement for the valve originally provided therein and to not require the expense of replacement of an existing air hammer with an entirely new hammer, rather than just the air valve portion thereof.

It is also among the several objects of the invention that the new pneumatic hammer air valve have fewer parts and that it functions in a manner which is superior to valves previously known in pneumatic hammers.

Accordingly, in furtherance of the above objects the present invention is, briefly, a hammer of the type having an impact tool driven by pressurized fluid with a hammer body portion with a closed rearward end and an open forward end and a piston longitudinally movably housed within the hammer body portion for striking a tool mounted at the open forward end of the hammer body portion, to thereby impact an object with the tool. The hammer has a fluid valve housed within the closed rearward end of the hammer body portion rearwardly of the piston and in communication with a source of high pressure fluid for driving the piston. The fluid valve has a valve body portion defining an interior chamber and a continuous exterior side wall, and a longitudinal opening in communication with the interior chamber. The valve body has a first body portion and second body portion which is identical to the first body portion and positioned longitudinally in relation thereto within the closed rearward end of the hammer body portion. The first valve body portion and the second valve body portion each have a face surface and a back surface, each face surface having an identical formed well area therein. The identical formed well areas are disposed facing and coaxial to one another, thereby defining the valve interior chamber when the valve is in normal operating position. The first valve body portion and the second valve body portion each have at least one open-sided transverse channel extending from the continuous, external side wall of the wall to the internal valve chamber to thereby simplify and facilitate manufacture of the valve body, and the longitudinal opening and the open-sided transverse channels permit access of pressurized fluid through the valve chamber between the closed rearward end of the hammer body portion and the piston to direct the flow of pressurized fluid entering the valve.

The invention is also, briefly, a valve for use in a pneumatically driven hammer having a piston. The valve includes a first valve body portion and a second valve body portion. The first valve body portion and the second valve body portion each have a longitudinal opening for passage therethrough of high pressure air, a disc having a first flat side and a second flat side and which is longitudinally movably sandwiched between the first valve body portion and the second valve body portion. The disc is sized so as to be capable of rapid movement back and forth between the first valve body portion and the second valve body portion to thereby alternately direct high pressure air coming through the valve to drive the piston forwardly to strike a hammer cutting tool and to drive the piston rearwardly to a pre-striking position. The first valve body portion and the second valve body portion each have a face surface and a back surface, each face surface having an identical well formed therein, which identical wells are disposed facing and coaxial to one another, thereby defining a valve interior chamber in which the disc is movably sandwiched when the valve is in normal operating position. The first valve body portion and the second valve body portion each have at least one transverse channel in communication with the valve chamber to permit access of pressurized fluid first to one and then the other of the first and second flat sides of the disc as it moves longitudinally within the valve chamber, to thereby direct the flow of pressurized fluid entering the valve to drive the piston forward and back in the hammer body portion to strike and then return to pre-striking position repeatedly in rapid succession. The at least one transverse channel of each of the first valve body portion and the second valve body portion are open-sided, to thereby simplify and facilitate manufacture of the valve body.

The invention is also, briefly, a valve for use in a pneumatically driven hammer having a piston, which valve includes a first valve body portion and a second valve body portion. The first valve body portion and the second valve body portion each have a longitudinal opening for passage therethrough of high pressure air and each have at least one transverse channel in communication with the longitudinal opening. The valve also has a disc having a first flat side and a second flat side longitudinally movably sandwiched between the first valve body portion and the second valve body portion. The disc is sized so as to be capable of rapid movement back and forth between the first valve body portion and the second valve body portion to thereby alternately direct high pressure air coming through the valve to drive the piston forwardly to strike a hammer cutting tool and to drive the piston rearwardly to a pre-striking position. The first valve body portion and the second valve body portion each have a face surface and a back surface, each face surface having an identical well formed therein, and the identical wells are disposed facing and coaxial to one another, thereby defining a valve interior chamber in which the disc is movably sandwiched when the valve is in normal operating position. The valve disc has a thickness between the first flat side and the second flat side which permits the disc to extend beyond a seam which is formed between the adjacent face surfaces of the first valve body portion and the second valve body portion, to thereby permit the disc to oscillate longitudinally within the valve chamber without catching on a seam formed between the facing surfaces of the first valve body portion and the second valve body portion while also permitting pressurized fluid to enter the valve chamber by flowing through the at least one transverse channel of the first valve body portion and the at least one transverse channel of the second valve body portion.

These and other objects will be in part apparent and in part pointed out hereinbelow.

BRIEF DESCRIPTION OF THE DRAWINGS

Throughout the drawings like parts are indicated by like element numbers.

DESCRIPTION OF PRACTICAL EMBODIMENTS

Figure 1:
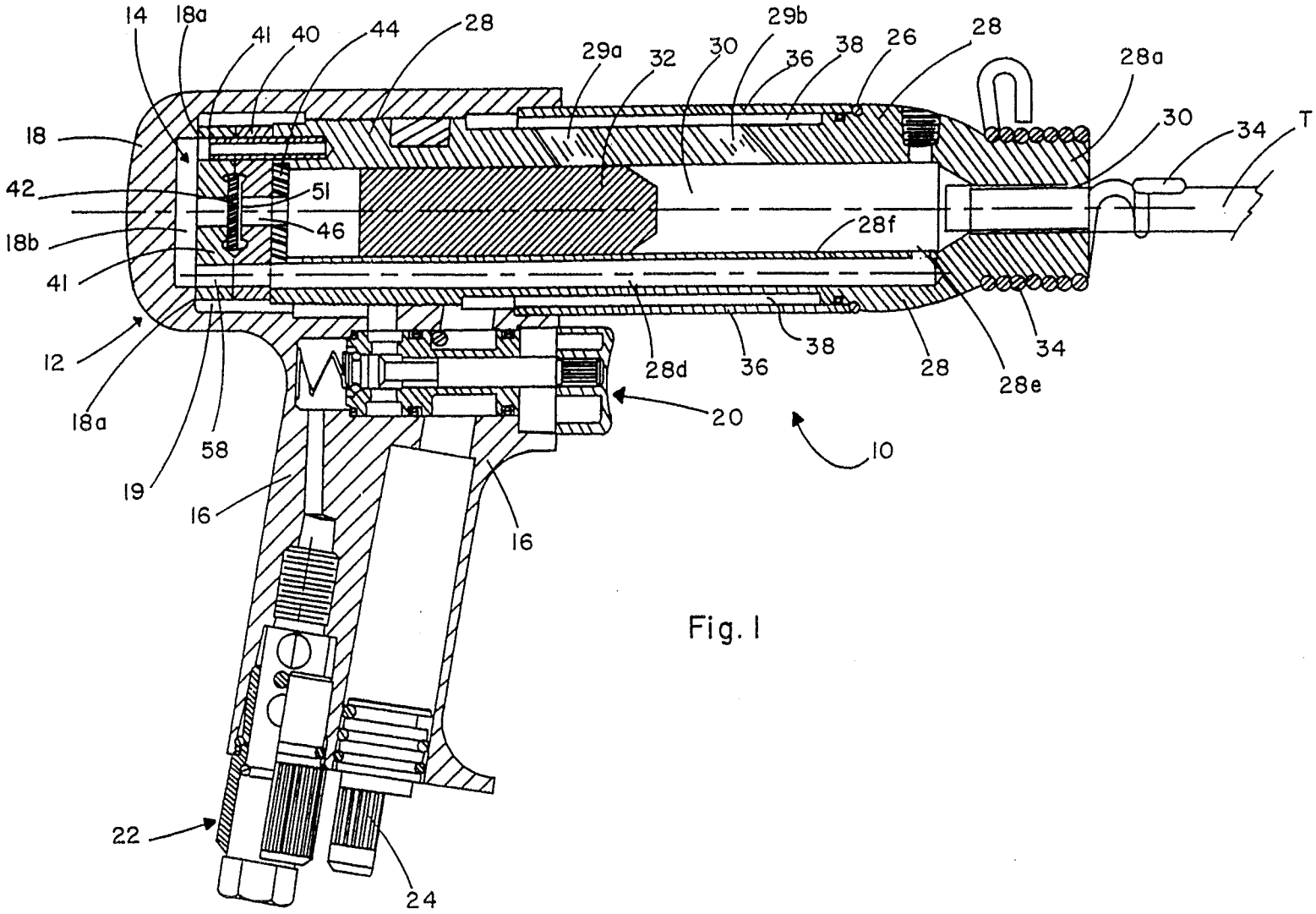
FIG. 1 is a longitudinal, partially sectional view of a pneumatic hammer having an air valve therein which is constructed in accordance with and embodies the present invention.

With reference to the drawings, and particularly with regard to FIGS. 1-10, 10 generally designates a pneumatic hammer having a main body portion 12 and a valve 14 housed therein, which valve is constructed in accordance with and embodies the present invention. With the exception of air valve 14, new pneumatic hammer 10 and the known pneumatic hammer 100 (shown in FIG. 15) are substantially the same. However, hammer 10 can take other overall forms, besides the usual pistol-grip style shown herein, and still be suitable for use with the new air valve.

For clarity and simplicity of discussion, all elements of air hammer 100 which are substantially the same as those of new hammer 10 are provided in the drawings with like element numbers. As the pneumatic hammer per se is of a conventional style, an overly detailed discussion thereof will be avoided. Some parts of the hammer, although shown, will not be called out because they do not pertain in any particularly significant manner specifically to the new air valve, and their structure can vary without altering the scope of the invention. A further embodiment of the new air valve will be discussed later with reference to FIGS. 11-14.

Main body portion 12 of hammer 10 includes a handle or grip 16 which is suitably penetrated longitudinally for passage in and out of pressurized air from a source thereof (not shown). Handle 16 depends from a butt portion 18 which is formed with a generally cylindrical forward opening for housing air valve 14 (101 in the case of tool 100), which is ultimately in communication with the inward and outward channels of air flow provided through handle 16.

Figure 11:
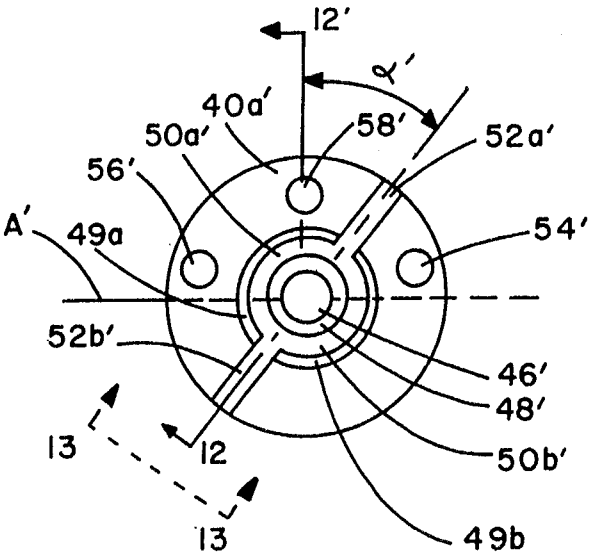
FIG. 11 is a face surface elevational view of one of two identical valve body portions of an alternative embodiment of the new air valve.
Figure 12:
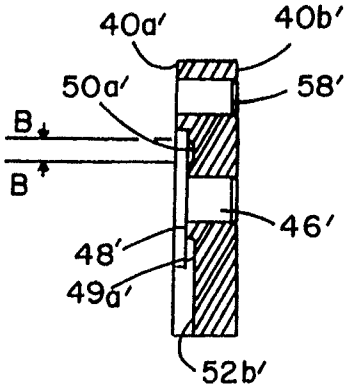
FIG. 12 is a sectional view taken on line 12—12 in FIG. 11.

FIGS. 1 and 11 show a spring-biased trigger assembly, generally designated 20, which is disposed generally transversely within handle 16 and constructed in known manner so that operation thereof initiates inflow from the source of pressurized air via a regulator assembly, for example, such as that generally designated 22, which is coupled to the base of handle 16.

As shown in FIG. 1, trigger assembly 20 is in the off or closed position. Upon depressing of the trigger pressurized air can pass through assembly 20 for operation of hammer 10, as will be described further hereafter.

Air outflow from hammer 10 is ultimately and preferably via an air deflector 24 which is ordinarily connected at the base of handle 16 adjacent to regulator assembly 22. Appropriately sized seals and O-rings, such as, for example, those indicated at 26, are disposed in the usual manner within the above assemblies and throughout pneumatic hammer 10, to ensure an air-tight fit of the parts of hammer 10 as required for proper functioning thereof.

With reference to FIG. 1, pneumatic hammer 10 has an elongated cylindrical barrel 28 which is preferably securely coupled, for example by threaded connection, to the forwardly open end of butt portion 18 of main body portion 10. Barrel 28 is formed with a longitudinal bore 30 for sliding travel therein of a piston 32. At the forward end of barrel 28 bore 30 opens outwardly and provides a site for connection of a known striking or cutting tool T, such as a chisel. A retainer such as that indicated at 34 is preferably provided at the forward extreme of barrel 28 to ensure against inadvertent displacement of the chisel or other selected cutting or striking tool T.

A narrow, longitudinal channel 28*d* is provided within barrel 28 and is desirably disposed substantially adjacent to and above trigger assembly 20. At the forward end of channel 28*d* there is an aperture 28*e* which permits passage of air through a wall 28*f* which separates channel 28*d* and bore 30 so that air can pass between channel 28*d* and barrel bore 30 for purposes to be described later.

Coaxially outward from barrel 28 there is mounted a cylindrical barrel cover or exhaust duct 36, the rearward end of which is journaled within the forwardly facing opening of butt portion 18 of main body 12. The forward end of barrel cover 36 is sealed securely to and spacedly outward from the barrel by O-rings which are seated against annular shoulders formed on the exterior side wall spacedly rearwardly of the forward end 28*a* of barrel 28.

In this manner, or by other known constructions, an exhaust air space 38 is formed around barrel 28 inside of and coaxial with exhaust duct 36. Air space 38 is in communication with bore 30 via exhaust apertures or ports 29*a*, 29*b* which are formed through the barrel for expulsion of air outwardly therefrom to exhaust air space 38 and ultimately through exhaust deflector 24 upon firing of hammer 10 and striking and recoil of piston 32.

Figure 2:
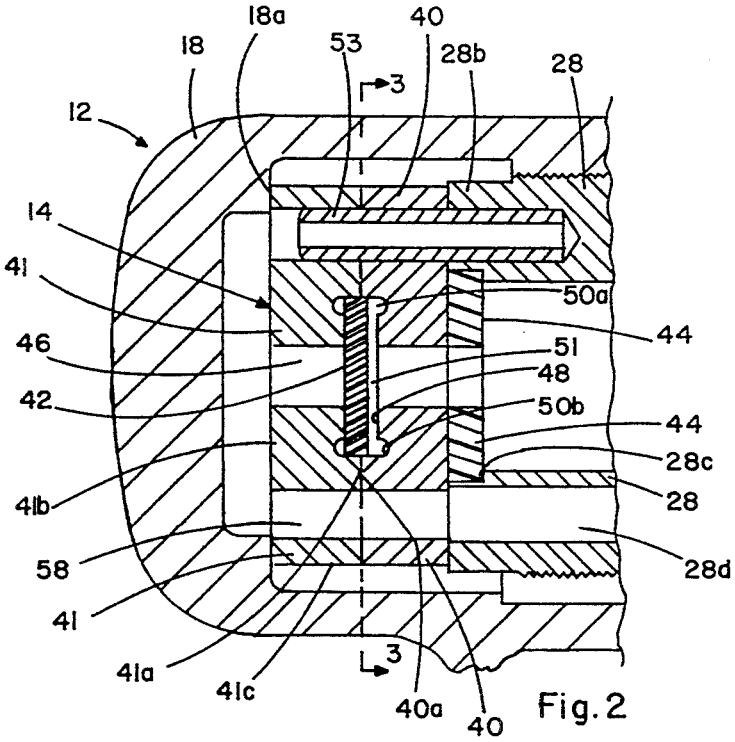
FIG. 2 is an enlarged view of the air valve and a portion of the pneumatic hammer of FIG. 1, partially broken away.

FIGS. 1 and 2 illustrate that new air valve 14 is disposed in coaxial alignment with and is adjacent to the rearward end 28*b* of barrel 28, inside of the closed butt end 18 of hammer 10. Generally, new air valve 14 consists of paired, facing, identical valve body halves 40, 41 which loosely sandwich a valve disc 42 therebetween, and a bumper/seal 44 disposed forwardly of the valve body halves, rearwardly of piston 32, transversely across the opening of barrel rearward end 28*b* and coaxially with valve body halves 40, 41.

More specifically, each valve body half 40, 41 has a substantially planar face surface 40*a*, 41*a*, respectively, and a substantially planar back surface 40*b*, 41*b*, respectively. The face and back surfaces are preferably circumferentially limited by a corresponding annular side wall 40*c*, 41*c* which extends between and connects the face 40*a*, 41*a* and back 40*b*, 41*b* surfaces of a particular valve body half. As shown in FIGS. 1 and 2, valve body half or portion 40 is disposed coaxially, forwardly of valve body half 41, which is seated against an annular shoulder 18*a* formed within the closed butt end 18 of hammer body 12. With valve 14 so positioned, an annular space 19 extends around valve 14 from the outer, circular side wall thereof to the interior surrounding wall of butt portion 18 of main body 12, forwardly of ledge 18*a*.

For normal operation of valve 14, the two identical valve body face surfaces 40*a*, 41*a* are positioned inwardly, facing and touching, flush against one another, with rear surface 40*b* directed forwardly and rear surface 41*b* disposed rearwardly with respect to the direction of hammer main body portion 12. Valve body portions 40*a*, 41*a* each have a preferred diameter of approximately 1.5 in. in this example. However, it is to be understood that this and other dimensions provided herein although preferred, may vary somewhat as may be appropriate for the particular application, such as for use of valve 14 within a pneumatic hammer having a different internal size or shape of main body butt portion 18.

It is to be recalled that valve body halves 40, 41 are identical and completely interchangeable. However, they are provided with different element numbers here for clarity, for purposes of this description regarding positioning. Nonetheless, when a particular structural feature of either one of valve body halves 40 or 41 is described it is to be understood to be present as well in the other valve body half. Valve body portions 40, 41 are desirably formed of a powdered metal alloy or plastic, but may optionally be formed of zinc or other sufficiently strong, durable substances, and are finished so as to be smooth, flash and burr free, for example by vibratory tumbling. All annular edges of valve 14 elements are preferably chamfered in order to reduce catching and wear.

FIGS. 3 through 6 illustrate in detail the structure of valve body portion 40 (41) and show a central circular opening 46 with a diameter of about 0.250 in. which permits passage therethrough of pressurized air. The perimeter of opening 46 is defined by the inner edge of an annular, flat surfaced ledge 48 which lies in a plane slightly depressed from the plane in which face surface 40*a* lies, for example by approximately 0.055 in.

Figure 5:
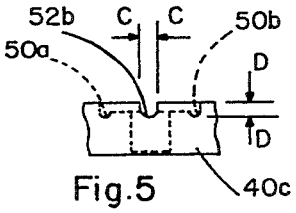
FIG. 5 is an elevational view from the direction shown by line 5—5 of FIG. 3.

The outer annular edge of ledge 48 in valve body portion 40 is defined for the most part by preferably two identical semicircular troughs 50*a*, 50*b*, each having a substantially "U"-shaped cross-section of approximately 0.115 in width (arrows B in FIG. 4) and have a depth of about 0.100 in from the level of face 40*a*, as indicated at arrows D in FIG. 5. Semicircular troughs 50*a*, 50*b* are separated from one another at their juxtaposed ends by open-sided straight channels 52*a*, 52*b* which extend radially outward from their corresponding points of intersection with troughs 50*a*, 50*b* through opposite sides of the outer annular side wall 40*c* of valve body half 40 and are also approximately 0.100 in. in depth. Channels 52*a*, 52*b* are preferably approximately 0.125 in. wide along their entire respective extents, as indicated at arrows C in FIG. 5.

Although, as shown in this preferred embodiment there are two, semi-circular shaped troughs 50*a*, 50*b*, it is conceivable that more than two troughs could be provided around ledge 48, having shapes other than semi-circular, and that the associated valve body portions could still function as desired. Similarly, the troughs and radially extending channels, rather than having the "U"-shaped cross sections shown could be "V"-shaped or flat bottomed and function at least adequately.

Thus, as seen in FIGS. 1–4, each valve body half 40, 41 has formed within its face surface a central well area, the perimeter of which is defined by semicircular channels 50*a*, 50*b*. When valve body portions 40, 41 are positioned in the face-to-face normal operative condition shown in FIG. 2 the facing well areas form a chamber 51 in which disc 42 (to be described further hereafter) is disposed, substantially transversely in relation to the longitudinal axis of hammer body 12.

Figure 6:
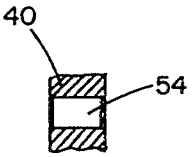
FIG. 6 is a sectional view taken on line 6—6 of FIG. 3.
Figure 3:
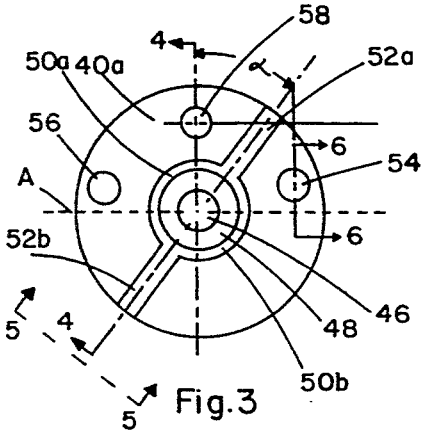
FIG. 3 is a face surface elevational view of one of two identical valve body portions of the new air valve, from the direction of line 3—3 of FIG. 2.
Figure 4:
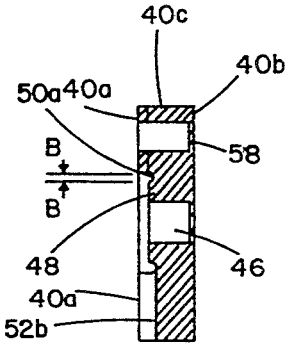
FIG. 4 is a sectional view taken on line 4—4 of FIG. 3.

FIGS. 3 and 6 show paired through-holes 54, 56 which penetrate valve body portion 40, and the centers of which are spaced radially outward from the center of valve body portion 40 by 0.575 in. Through-holes 54, 56 preferably pass longitudinally, entirely from one surface 40*a*, 40*b* to the other and are positioned adjacent to the horizontal line A shown in FIG. 3, spacedly therefrom, preferably by a distance of 0.150 in., on the same side as channel 52*a*.

As illustrated in FIGS. 2 and 11, through-holes 54, 56 serve to journal a retainer, such as spring pin 53 at one end thereof and thus are sized appropriately therefor. The opposed, forward end of spring pin 53 is received in a correspondingly sized opening in rear end 28*b* of barrel 28 in order to prevent rotary movement of valve body portion halves 40, 41. Other means of alignment and rotary position will of course suffice.

A third through-hole 58 longitudinally penetrates valve body half 40 at a point equidistant between through-holes 54, 56, at a distance of preferably about 0.550 in. radially outward from the center of valve body portion 40. In use, through-hole 58 of one valve body half 40, 41 is aligned longitudinally with through-hole 58 of the other valve half 40, 41 and serves as a passageway for pressurized air through valve 14 between cavity 18*b* and air channel 28*d*. With through-holes 58 so aligned, through-hole 54 of valve body portion 40 is longitudinally aligned with through-hole 56 of valve body half 41, and vice-versa.

Accordingly, straight channels 52*a*, 52*b* of one valve body half 40, 41 are not positioned so as to overlap those of the other valve body half, but instead are offset so that high pressure air can only enter valve 14 through the straight channels on one valve body portion at a time, which portion 40, 41 depending upon the position of disc 42.

In the preferred embodiments described herein the center of through-hole 58 is 38 degrees from the longitudinal axis of channel 52*a*, as indicated at angle $\alpha$ in FIG. 3. Of course this position may vary depending upon the overall structure of the particular pneumatic hammer in which new valve 14 is employed.

Figure 9:
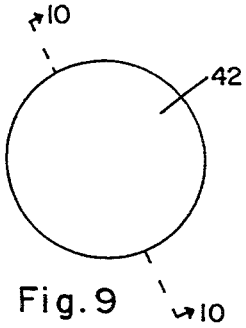
FIG. 9 is an elevational view of one of the flat working surfaces of the disc of the valve of FIG. 1, the opposite side surface being identical.
Figure 10:
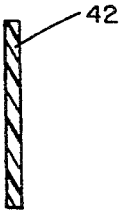
FIG. 10 is a sectional view taken on line 10—10 of FIG. 9.

The above-mentioned disc 42 is shown in FIGS. 9 and 10, and in normal operating position, loosely sandwiched between valve body portions 40, 41 in FIGS. 1 and 2. Disc 42 is preferably formed as an uninterrupted plane with a circular perimeter and made of a tough, rigid, reinforced phenolic or polymer material. In the preferred embodiments disc 42 is approximately 0.742 in. in diameter and about 0.067 in. thick, with variations of ±0.003 in. being acceptable. The edges of disc 42 are finished sufficiently to be completely free of burrs.

So sized and shaped, disc 42 can oscillate or "flutter" longitudinally within chamber 51 between the facing valve body halves 40, 41 upon supply of pressurized air to hammer 10. Thus air is supplied to drive piston 32 forwardly, but the new valve structure also, by fluttering to its alternate position, causes a cushion of air to be formed ahead of valve 14 in bore 30 behind the piston to reduce the impact of the recoiling piston against the valve, before the piston is again forced forwardly, and thereby extends the useful life of both the valve and the associated hammer. The operation of valve 14 will be described to a greater extent herein, after further description of its structure.

Figure 15:
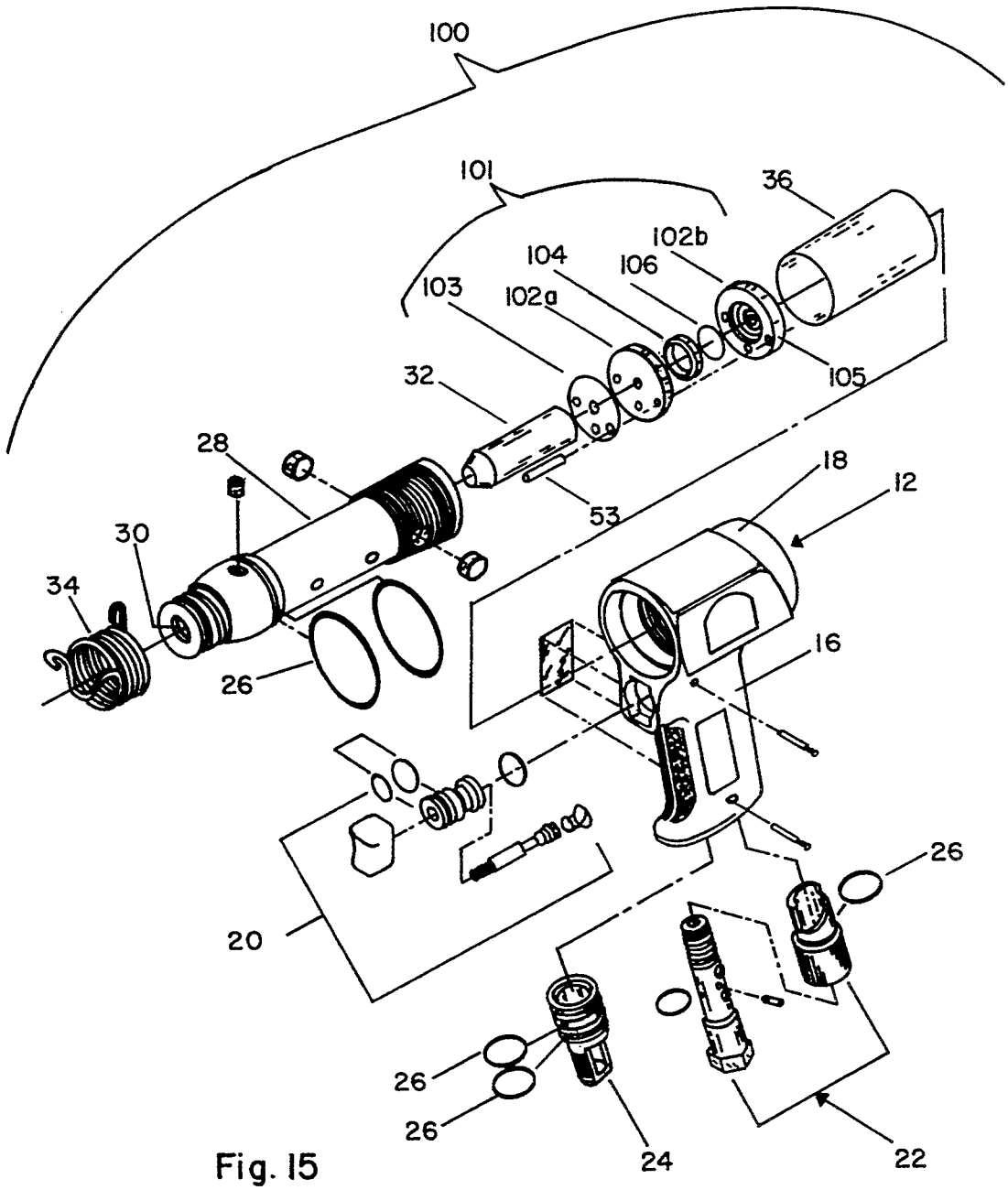
FIG. 15 is an exploded view of a pneumatic hammer and an air valve therein constructed in accordance with the known art.

The particular described structure of disc 42, with a thickness greater than the distance of valve body half ledge 48 from the face surface of the respective valve body half has the unique advantage of permitting proper operation of valve 14 while completely eliminating the internal valve sleeve 104, seen in FIG. 15. Sleeve 104 was previously necessary to prevent the internal metal disc 106 from catching on the seam between the facing valve body portions. Such catching cannot occur in the present preferred embodiment because disc 42 is thick enough to overlap the seam between abutting face surfaces 40*a*, 41*a* by a distance of approximately 0.005 to approximately 0.010 in. (shown exaggerated in FIGS. 1 and 2 for clarity).

Figure 7:
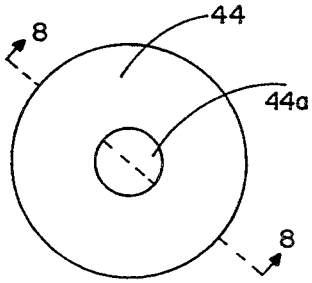
FIG. 7 is an end elevational view of the seal of the valve of FIG. 1.
Figure 8:
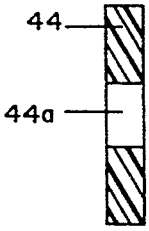
FIG. 8 is a sectional view taken on line 8—8 of FIG. 7.

The new combined bumper/seal 44 of valve 14 is shown in detail in FIGS. 7 and 8 and is a generally washer-shaped device preferably formed of polyurethane or some other suitably durable, pliable material, to a thickness of 0.130 in. and with a diameter of 0.840 in. A hole 44*a* formed centrally in bumper/seal 44 has a diameter of 0.250 in. so as to match the diameter of central opening 46 in each valve body half 40, 41 and to allow passage therethrough of pressurized air for driving piston 32.

In normal operating position shown in FIGS. 1 and 2, bumper/seal 44 is coaxially aligned with valve body half 40, forwardly thereof and is snugly disposed in an annular seat 28*c* (FIG. 2 only) within the rearward facing end 28*b* of barrel 28, so as to form a substantially air-tight seal between the barrel and the forward facing back surface 40*b* of valve body half 40. Bumper/seal 44 also performs the additional function of protecting valve body portions 40, 41 from the impact of the recoiling piston 32 by acting as a bumper, and additionally serving to store some of the energy imparted by the recoiling piston and releasing that energy forwardly during the repeated, high velocity firing of hammer 10.

FIGS. 11–14 illustrate an alternative embodiment for the valve body portions 40', 41' of the new air valve which operate in similar manner as the valve body halves or portions 40, 41 in the first embodiment. The alternative valve body portions (halves) 40', 41' are used with the same valve disc 42 and bumper/seal 44. Elements of the alternative valve body portion which correspond to those previously described are denoted by the same element number followed by the "prime" suffix, and, if identical in form and function, may be shown in the figures but not discussed below, for simplicity and to avoid unnecessary repetition in this description. New elements are assigned new element numbers. As with the previous embodiment, each valve body half 40' is identical to each valve body half 41'.

In detail, valve body portions 40', 41' each include a central circular opening 46' with a diameter of about 0.250 in. which permits passage therethrough of pressurized air. The perimeter of opening 46' is defined by the inner edge of an annular, flat surfaced ledge 48' which lies in a plane slightly depressed from the plane in which face surface 40*a'* lies, for example by approximately 0.055 in.

Figure 13:
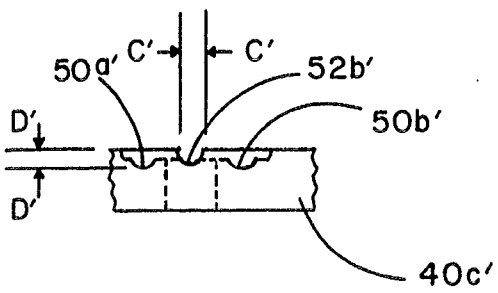
FIG. 13 is an elevational view taken from the direction shown by line 13—13 in FIG. 11.
Figure 14:
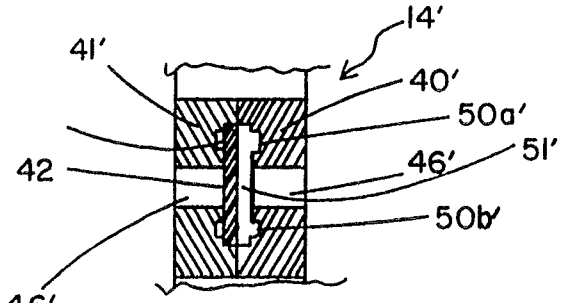
FIG. 14 is a partial sectional view showing the disc in working position between the two identical facing valve body portions of the embodiment shown in FIG. 11.

The outer annular edge of ledge 48' in valve body portion 40' is defined for the most part by preferably two identical semicircular troughs 50*a'*, 50*b'*, each having a substantially "U"-shaped cross-section of approximately 0.115 in width (arrows B' in FIG. 12) and have a depth of about 0.100 in from the level of face 40*a'*, as indicated at arrows D' in FIG. 13.

The outer edges of troughs 50*a'*, 50*b'* are defined by the inside edges of semi-circular (or otherwise correspondingly shaped) ledges 49*a*, 49*b*. Thus, travelling radially outward from central opening 46', the plane of innermost ledge 48' is depressed somewhat downwardly or inwardly from the plane of face surface 40*a'*, from ledge 48' there is a deep step down into channels 50*a'*, 50*b'* which connect at their adjacent ends to form one continuous depressed ring. From channel(s) 50*a'*, 50*b,'* outwardly, there is then encountered a step upwardly to semi-circular ledges 49*a*, 49*b*, which lie in the same plane as innermost, circular, ledge 48'. Continuing radially outward from ledge 48' there is a straight, annular side wall at the outer edge of ledge 48' which steps upwardly to intersect face surface 40*a'* and which forms one half of the outermost wall of chamber 51' in which disc 42 is held, loosely sandwiched between facing, coaxial valve body halves 40', 41'.

Semicircular troughs 50*a'*, 50*b'* are separated from one another at their juxtaposed ends by radial channels 52*a'*, 52*b'* which extend straight outwardly from their corresponding points of intersection with troughs 50*a'*, 50*b'* through opposite sides of the outer annular side wall 40*c'* of valve body half 40' and are also approximately 0.100 in. in depth Channels 52*a'*, 52*b'* are preferably approximately 0.125 in. wide along their entire respective extents, as indicated at arrows C' in FIG. 13.

With reference to FIG. 1, the operation of new hammer 10 with new valve 14 therein is described hereafter. During use of hammer 10 and new valve 14, 14' (i.e., with either of the preferred valve body embodiments described) depressing the button of trigger assembly 20 permits flow of high pressure air through regulator assembly 22 in handle 16, through trigger assembly 20, and into annular space 19. When disc 42 is in the rearward position shown in FIG. 1, high pressure air in space 19 enters valve 14 through straight channels 52*a*, 52*b* and is forced forwardly through through-hole 46 in forward valve body half 40 and into bore 30 behind piston 32, thereby forcing piston 32 forwardly until striking tool T.

As piston 32 moves forwardly both the rearward 29*a* and forward 29*b* exhaust ports become blocked by the piston and the piston necessarily compresses air forwardly of it in bore 30. This compressed air is then forced through aperture 28*e* in wall 28*f* into narrow channel 28*d*. The air in channel 28*d* then flows rearwardly through aligned apertures 58 in valve body portions 40, 41, into cavity 18*b* where it enters the central opening 46 in valve body portion 41 and asserts pressure against the rearward facing flat surface of disc 42.

As piston 32 passes sufficiently far forwardly in barrel 28 it passes and thus uncovers the rear exhaust port 29*a*. The result is a pressure drop in bore 30 behind the piston as air passes from that area into annular air space 38, prior to being expelled from hammer 10 via exhaust deflector assembly 24.

Substantially simultaneously, the air compressed in front of the piston and flowing into channel 28*d* increases until it applies sufficient pressure against disc 42 to cause it shift to its alternate, forward position (not shown) within central chamber 51 between valve body portions 40, 41. In this position, disc 42 blocks the central opening and the radially extending, open-sided straight channels in the forward valve body half and those elements become uncovered in the rearward valve body half.

Piston 32 continues forwardly until striking tool T. At that point, because the disc has moved forward and is closing off opening 46 in forward valve body half 40, high pressure air entering annular space 19 via trigger assembly 20 passes through the straight, radially extending channels 52*a*, 52*b* of rear valve body half 41 and is directed rearwardly through central opening 46 thereof, into cavity 18*b* and then forwardly through narrow channel 28*d*, through forward opening 28*e* therein and into bore 30 in front of piston 32 to cause the piston to begin to move rearwardly toward its prestriking position. As piston 32 moves rearwardly in barrel 28 it forces air behind it in the bore outwardly through the rearward exhaust port 29*a* into annular space 38. This exhausted air ultimately leaves hammer 10 via exhaust deflector 24.

As the piston moves rearwardly it begins to pass and blocks rear exhaust port 29*a*, and thus the air in the bore behind the piston becomes compressed. As the piston continues rearwardly the front of the piston eventually clears the front exhaust port 29*b* and high pressure air escapes therethrough into space 38 beneath the exhaust shield 36. This results in a sudden drop in pressure in the front of bore 30 while the air behind the piston at the rear of the bore continues to be further compressed.

The air compressed behind the rearwardly moving piston forms a cushion between bumper/seal 44 and is forced through the central aperture thereof and through the central opening 46 of forward valve body half 40; and, when the pressure is sufficiently great, forces disc 42 into its rearward position in chamber 51, as shown in FIG. 1.

In this position disc 42 blocks the straight, open-sided channels and the central opening in rear valve body portion 41, and the straight channels 52*a*, 52*b* of forward valve body portion 40 are again unblocked so that high pressure air entering hammer 10 can once again flow into central opening 46 and forwardly therethrough, assisting in the piston-cushioning effect and building pressure until reaching a sufficient level to cause the piston to fire again. This cycle repeats at a rate of approximately 2100 times per minute.

With the above-described constructions, manufacture of valve 14, 14' and assembly of hammer 10 with either of the preferred valves or their equivalents is much more efficient and economical in comparison to previous air valves for pneumatic hammers. Difficult to manufacture tunnels 105 which transversely penetrate the walls of the known valve body portions are no longer required. Valve sleeve 104 is completely eliminated in the new air valve and the modified disc and valve body interaction greatly simplifies manufacture. Additionally, the specific structure of the new air valve with a strong polymer or phenolic disc and thick and resilient bumper/seal greatly reduces wear on the valve itself which is induced by peening forces as the disc oscillates at approximately 2100 times per minute. Thus, wear on the hammer generally is reduced and the useful life thereof is extended.

In view of the foregoing, it will be seen that the several objects of the invention are achieved and other advantages are attained.

Although the foregoing includes a description of the best mode for carrying out the invention, various modifications are contemplated.

As various modifications could be made in the apparatus herein described and illustrated without departing from the scope of the invention, it is intended that all matter contained in the foregoing description or shown in the accompanying drawings shall be interpreted as illustrative rather than limiting.

What is claimed is:

1. A hammer of the type having an impact tool driven by pressurized fluid, the hammer comprising:

a hammer body portion having a closed rearward end and an open forward end, a piston longitudinally movably housed within the hammer body portion for striking a tool mounted at the open forward end of the hammer body portion, to thereby impact an object with the tool, and a fluid valve housed within the closed rearward end of the hammer body portion rearwardly of the piston and in communication with a source of high pressure fluid for driving the piston, the fluid valve having a valve body portion defining an interior chamber and having a continuous exterior side wall, a longitudinal opening in communication with the interior chamber, wherein the valve body has a first body portion and second body portion which is identical to the first body portion and positioned longitudinally in relation thereto within the closed rearward end of the hammer body portion, the first valve body portion and the second valve body portion each having a face surface and a back surface, each face surface having an identical formed well area therein, the identical formed well areas being disposed facing and coaxial to one another, thereby defining the valve interior chamber when the valve is in normal operating position, the first valve body portion and the second valve body portion each having at least one open-sided transverse channel extending from the continuous, external side wall of the wall to the internal valve chamber to thereby simplify and facilitate manufacture of the valve body, and the longitudinal opening and the open-sided transverse channels permitting access of pressurized fluid through the valve chamber between the closed rearward end of the hammer body portion and the piston to direct the flow of pressurized fluid entering the valve to drive the piston forward and back in the hammer body portion to strike and then return to pre-striking position repeatedly in rapid succession, for causing firing and return of the piston to its pre-firing position as a valve disc moves between a first disc position and a second disc position in the internal chamber, and a disc movably contained within the internal chamber.

2. The hammer of claim 1, and further wherein in the well area formed in each of the first valve body portion and the second valve body portion there is formed a first ledge having an inner edge and an outer edge, the inner edge defining the perimeter of a longitudinal opening of each of the first valve body portion and the second valve body portion, to thereby define the longitudinal opening of the valve body when the first valve body portion and the second valve body portion are disposed coaxially and longitudinally within the closed rearward end of the hammer body portion rearwardly of the piston, with the corresponding face surface of each of the first valve body portion and the second valve body portion being adjacent to and flush against one another.

3. The hammer of claim 1, wherein the disc has a first flat side and a second flat side and is disposed transversely relative to the longitudinal axis of the hammer within the valve interior chamber, and further wherein the disc has a width relative to the size of the valve interior chamber so as to be capable of oscillating rapidly forwardly and rearwardly therein upon supply of pressurized fluid from one and then the other of the first and second flat sides of the disc.

4. The hammer of claim 1, wherein the first valve body portion and the second valve body portion each have at least two transverse channels in communication with the valve chamber.

5. The hammer of claim 1, wherein the at least one open-sided transverse channel of each of the first valve body portion and the second valve body portion extend straight and radially outward from the well area of the corresponding valve body portion to the exterior side wall of the valve body.

6. The hammer of claim 1, wherein the valve disc has a thickness between the first flat side and the second flat side which is less than the depth of the well area of the first valve body portion and the second valve body portion, and greater than the distance from an outer surface of the ledge to the face surface of the corresponding valve body portion, to thereby permit the disc to oscillate longitudinally within the valve chamber without catching on a seam formed between the facing surfaces of the first valve body portion and the second valve body portion while also permitting pressurized fluid to enter the valve chamber by flowing through the at least one transverse channel to the formed troughs.

7. The hammer of claim 2, wherein each of the first valve body portion and the second valve body portion have troughs formed in the corresponding face surfaces thereof, the formed troughs having bottom surfaces which define the floor of the well area of the corresponding valve body portion and inner walls extending toward the face surface of the corresponding valve body portion, which inner walls define the outer perimeter of the corresponding first ledge, the formed troughs being in communication with the at least one transverse channel in the valve body for permitting flow of pressurized fluid to the valve chamber.

8. The hammer of claim 7, wherein each first ledge has a height which is less than the distance from the floor of the well area to the face surface of the corresponding first valve body portion and second valve body portion.

9. The hammer of claim 7, wherein each of the first valve body portion and the second valve body portion have a second ledge at the perimeter of the corresponding central well area, the second ledge having a height from the floor of the well area which is equal to the height of the first ledge from the floor of the central well area, the first ledge and the second ledge being spaced apart from one another by the width of the formed troughs which are formed between the first ledge and the second ledge.

10. The hammer of claim 1, wherein the first valve body portion and the second valve body portion are formed of a material having a degree of hardness greater than that of the material of which the disc is formed so as to reduce wear caused by peening forces on the first valve body portion and the second valve body portion as the disc moves in the chamber defined therebetween, to thereby extend the useful life of the valve and the associated hammer.

11. The hammer of claim 1, wherein the longitudinal opening is formed centrally in the valve body.

12. The hammer of claim 1, wherein the first valve body portion and the second valve body portion are formed of cast metal.

13. The hammer of claim 1, wherein the valve disc is formed of a plastic material.

14. The hammer of claim 1, wherein the valve disc is formed of a phenolic material.

15. The hammer of claim 1, wherein the fluid valve further comprises a bumper/seal which is formed of a durable, pliable material having the shape of a washer and which is disposed between the valve and the piston within the hammer body portion to protect the valve from impact upon recoil of the piston after firing.

16. The hammer of claim 15, wherein the bumper/-seal is formed of polyurethane.

17. The hammer of claim 1, wherein the hammer is pneumatically driven and the valve is an air valve.

18. A valve for use in a pneumatically driven hammer having a piston, the valve comprising:

a first valve body portion and a second valve body portion, the first valve body portion and the second valve body portion each having a longitudinal opening for passage therethrough of high pressure air, a disc having a first flat side and a second flat side and being longitudinally movably sandwiched between the first valve body portion and the second valve body portion, the disc being sized so as to be capable of rapid movement back and forth between the first valve body portion and the second valve body portion to thereby alternately direct high pressure air coming through the valve to drive the piston forwardly to strike a hammer cutting tool and to drive the piston rearwardly to a pre-striking position, wherein the first valve body portion and the second valve body portion each have a face surface and a back surface, each face surface having an identical well formed therein, and further wherein the identical wells are disposed facing and coaxial to one another, thereby defining a valve interior chamber in which the disc is movably sandwiched when the valve is in normal operating position, and further wherein the first valve body portion and the second valve body portion each have at least one transverse channel in communication with the valve chamber to permit access of pressurized fluid first to one and then the other of the first and second flat sides of the disc as it moves longitudinally within the valve chamber, to thereby direct the flow of pressurized fluid entering the valve to drive the piston forward and back in the hammer body portion to strike and then return to pre-striking position repeatedly in rapid succession, and further wherein the at least one transverse channel of each of the first valve body portion and the second valve body portion are open-sided, to thereby simplify and facilitate manufacture of the valve body.

19. The valve of claim 18, wherein the disc is disposed transversely relative to the longitudinal axis of the hammer within the valve interior chamber, and further wherein the disc has a width relative to the size of the valve interior chamber so as to be capable of oscillating rapidly forwardly and rearwardly therein upon supply of pressurized fluid from one and then the other of the first and second flat sides of the disc.

20. A valve for use in a pneumatically driven hammer having a piston, the valve comprising:

a first valve body portion and a second valve body portion, the first valve body portion and the second valve body portion each having a longitudinal opening for passage therethrough of high pressure air and each having at least one open-sided transverse channel in communication with the longitudinal opening, a disc having a first flat side and a second flat side and being longitudinally movably sandwiched between the first valve body portion and the second valve body portion, the disc being sized so as to be capable of rapid movement back and forth between the first valve body portion and the second valve body portion to thereby alternately direct high pressure air coming through the valve to drive the piston forwardly to strike a hammer cutting tool and to drive the piston rearwardly to a pre-striking position, wherein the first valve body portion and the second valve body portion each have a face surface and a back surface, each face surface having an identical well formed therein, and further wherein the identical wells are disposed facing and coaxial to one another, thereby defining a valve interior chamber in which the disc is movably sandwiched when the valve is in normal operating position, and further wherein the valve disc has a thickness between the first flat side and the second flat side which permits the disc to extend beyond a seam which is formed between the adjacent face surfaces of the first valve body portion and the second valve body portion, to thereby permit the disc to oscillate longitudinally within the valve chamber without catching on a seam formed between the facing surfaces of the first valve body portion and the second valve body portion while also permitting pressurized fluid to enter the valve chamber by flowing through the at least one transverse channel of the first valve body portion and the at least one transverse channel of the second valve body portion.

* * * * *